US006695751B1

(12) United States Patent
Hsu

(10) Patent No.: US 6,695,751 B1
(45) Date of Patent: Feb. 24, 2004

(54) JOGGING MACHINE HAVING A JOGGING PLATFORM ADJUSTABLE AND FOLDABLE STRUCTURE

(76) Inventor: Long-Chuan Hsu, No. 39, Sha Luen, Chung Sha Vill, An Din Hsiang, Tainan Hsien (TW)

( * ) Notice: Subject to any disclaimer, the term of this patent is extended or adjusted under 35 U.S.C. 154(b) by 0 days.

(21) Appl. No.: 10/382,528

(22) Filed: Mar. 7, 2003

(51) Int. Cl.[7] ..... A63B 22/02
(52) U.S. Cl. ..... 482/54
(58) Field of Search ..... 482/51–54

(56) References Cited

U.S. PATENT DOCUMENTS 5,868,648 A * 2/1999 Coody et al. ..... 482/54
6,193,634 B1 * 2/2001 Hurt ..... 482/54
6,325,745 B1 * 12/2001 Yu ..... 482/54
6,579,211 B2 * 6/2003 Wu ..... 482/54

* cited by examiner

*Primary Examiner*—Stephen R. Crow
(74) *Attorney, Agent, or Firm*—Rosenberg, Klein & Lee

(57) ABSTRACT

A jogging machine having a jogging platform adjustable and foldable structure comprises a base, a jogging platform, a wheel base, a linear actuating device, and two pumps. The base and the jogging platform are pivoted by a pair of arms. The base comprises a pair of rails inwardly. The wheel base has one end located underneath the jogging platform and the other end provided with a pair of wheels sliding on the rails of the base. The wheel base is linked by the linear actuating device to slide. The pumps are secured between the base and the jogging platform. When the jogging machine is not in use, the jogging platform is folded with respect to the base by the arms and the pumps will hold the jogging platform at place.

2 Claims, 6 Drawing Sheets

JOGGING MACHINE HAVING A JOGGING PLATFORM ADJUSTABLE AND FOLDABLE STRUCTURE

FIELD OF THE INVENTION

This invention relates to a jogging machine, and more particularly, to a jogging machine having a jogging platform adjustable and foldable structure.

BACKGROUND OF THE INVENTION

Living in this modern world people are driven to make living. People spend more time indoor and less time to go outdoor life. In order to keep physical in shape, various indoor exercise equipments are invented. One of which is a jogging machine, which is a mild exercise machine and can be folded when not in use. However, when the jogging platform of the jogging machine is lifted upwardly, the entire weight of the jogging platform falls onto a linear actuating device to stand still, which shortens the life span of the linear actuating device.

SUMMARY OF THE INVENTION

It is the primary object of the present invention to provide a jogging machine having a jogging platform adjustable and foldable structure, which runs more steady and more comfortably.

It is another object of the present invention to provide a jogging machine having a jogging platform adjustable and foldable structure, which is much safe in folding status.

It is a further object of the present invention to provide a jogging machine having a jogging platform adjustable and foldable structure, which can last longer.

DETAILED DESCRIPTION OF THE PREFERRED EMBODIMENT

Figure 1:
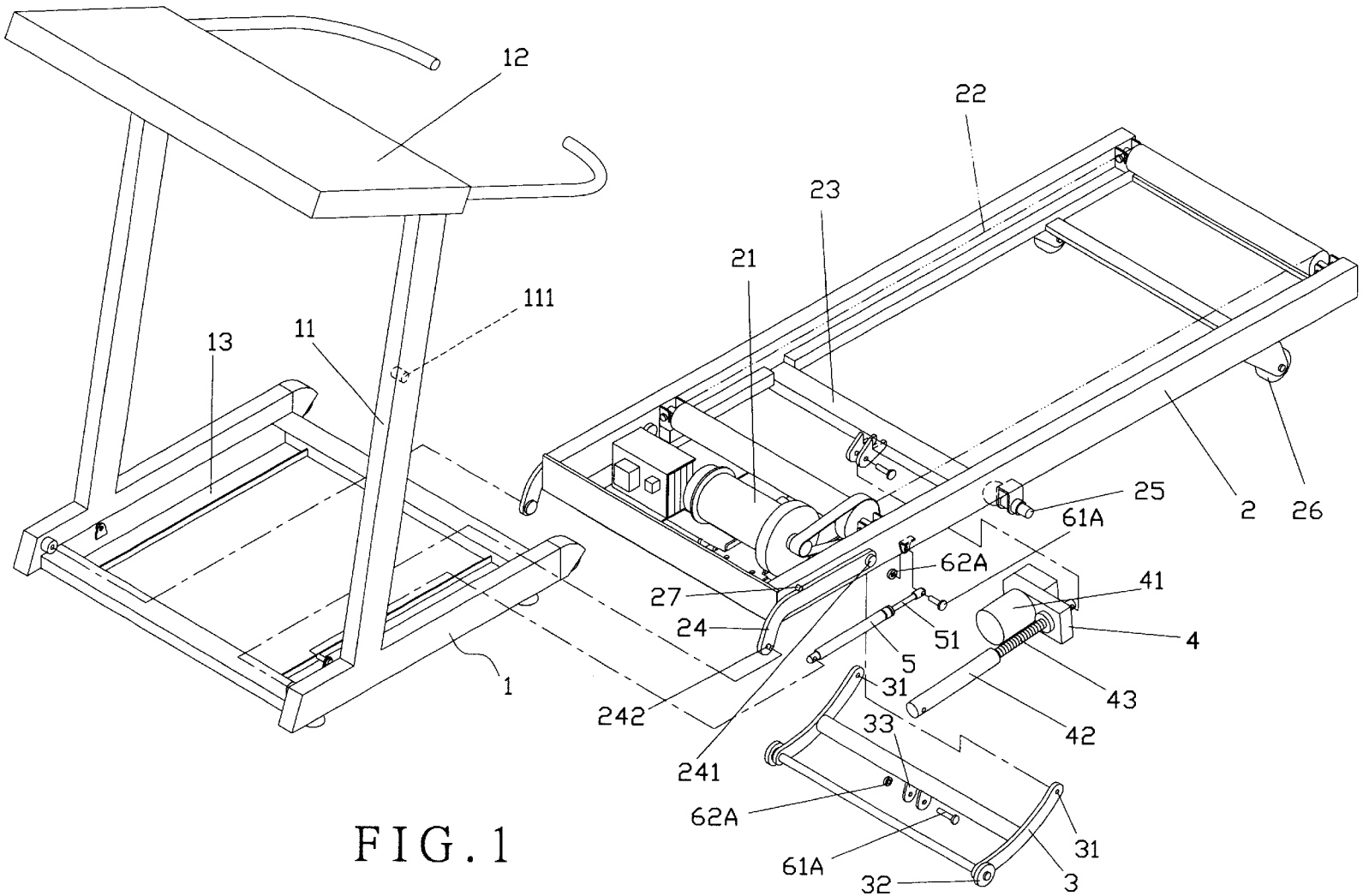
FIG. 1 is an exploded view of the present invention.

A jogging machine having a jogging platform adjustable and foldable structure comprises a base 1, a jogging platform 2, a wheel base 3, a linear actuating device 4 and two pumps 5.

The base 1 is laid flat on the floor and comprises a pair of side supports 11 to support a panel 12 on the top thereof. One of the side supports 11 has a hole 111, and the lower portion of the base 1 is provided with a pair of rails 13.

The jogging platform 2 has a motor 21, a pulley 22, and a plurality of ribs 23 crossly secured to the bottom thereof. Two L-shaped arms 24 are secured to the front end of the jogging platform 2 with one end 241 of each arm 24 pivoted to the jogging platform 2 and the other end 242 pivoted to the base 1 to connect the base 1 and the jogging platform 2 together. A stopper 25 is formed on one side of the jogging platform 2, which has a spring 251 at the inward. When the jogging platform 2 is in a standing position, the stopper 25 will be located in the hole 111 of the side support 11 of the base 1. The other end of the jogging platform 2 is provided with a pair of rollers 26 thereat. A pair of pins 271 is formed on the two sides of the jogging platform 2 above the arms 24.

The wheel base 3 is located underneath the jogging platform 2, and has one end 31 pivoted to the jogging platform 2 while the other end is provided with a pair of wheels 32 sliding onto the rails 13 of the base 1, and further comprises a pair of lugs 33 at a center rod thereof.

The linear actuating device 4 is a spiral elevating device being secured to one of the ribs 23 of the jogging platform 2 and is activated by a motor 41 to spin a bolt 43 to move in and out within a tube 42 in a threaded manner. The tube 42 has one end pivoted to the lugs 33 of the wheel base 3 by means of a fastener 6 composed of a bolt 61 and a nut 62 to pull and push the wheel base 3 along the rails 13 of the base 1.

The pumps 5 are secured on respective sides of the jogging platform 2. Each pump 5 has a strut 51 with one end of the strut 51 secured to the bottom of the jogging platform 2 by means of a fastener 6A composed of a bolt 61A and a nut 62A while the other end of the pump 5 is pivoted on the base 1.

Figure 2:
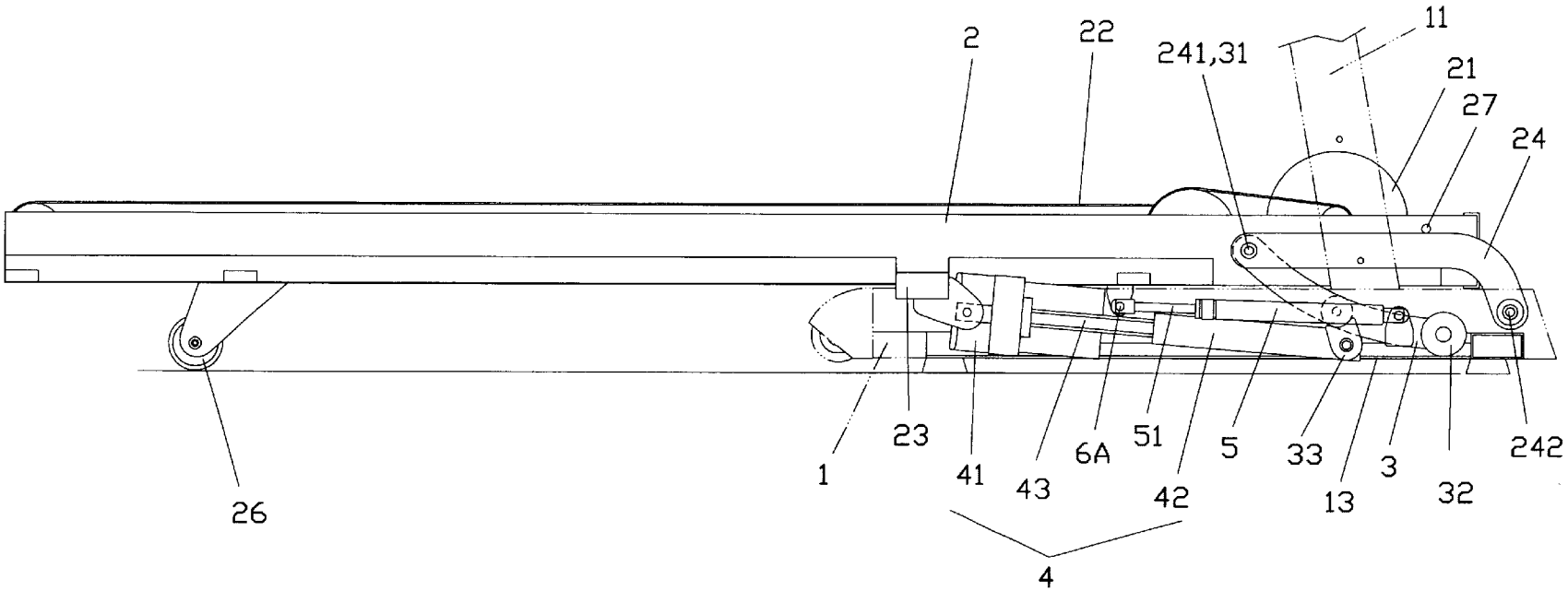
FIG. 2 is a side perspective view of FIG. 1.
Figure 3:
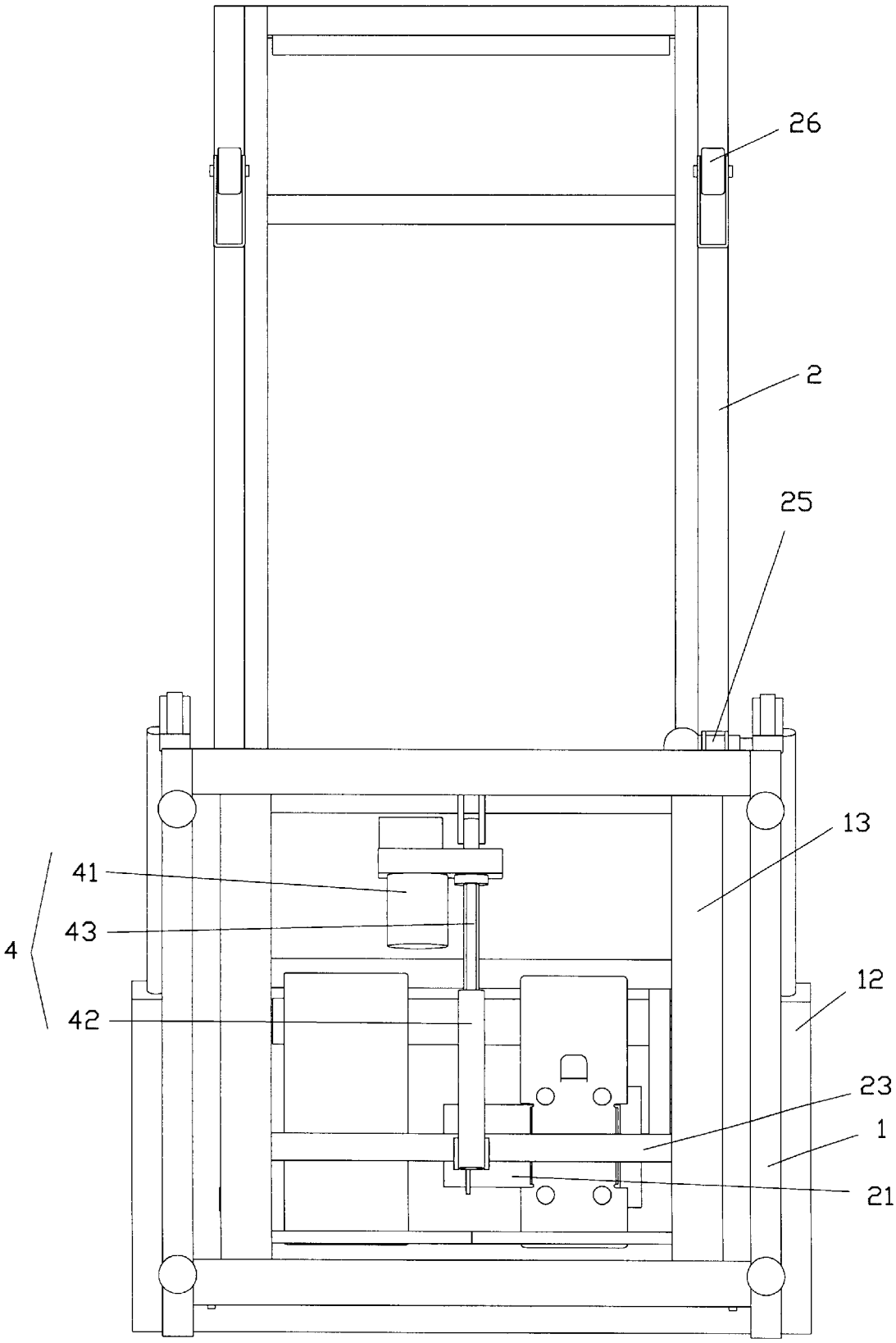
FIG. 3 is a bottom view of FIG. 1.

To assemble the present invention, the base 1 is placed on the ground, as shown in FIGS. 2 and 3, the front end of the jogging platform 2 is seated on the base 1 and pivoted with the front ends 241 of the two arms 24 to the base 1. The rear end of the jogging platform 2 is supported by the rollers 26 on the ground. The wheel base 3 is also secured to the bottom of the jogging platform 2 close to the ends 241 of the arms 24. The pins 27, at this moment, are seated above the arms 24, which also keep the jogging platform 2 at place when in a folding status. The linear actuating device 4 has the tube 42 pivoted to the lugs 33 at the center section of the wheel base 3.

Figure 4:
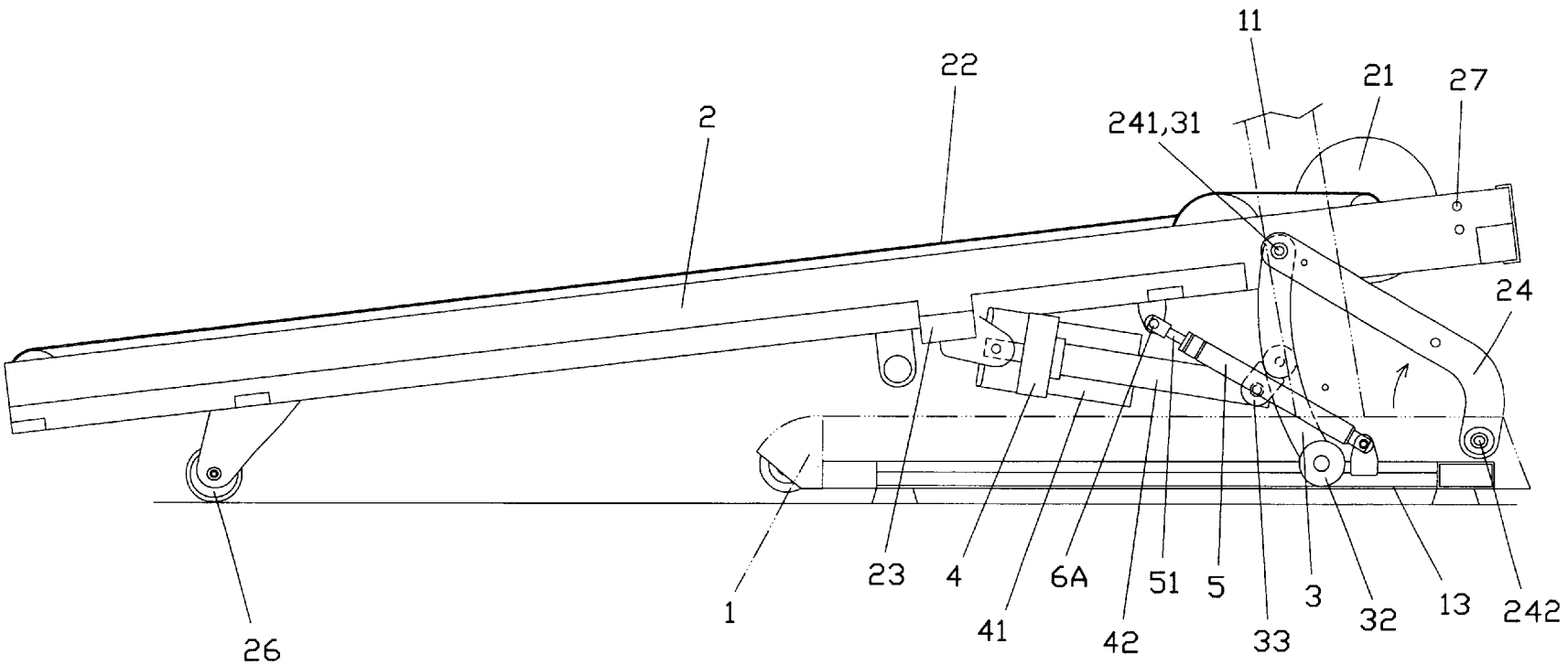
FIG. 4 is a side view of FIG. 1, showing the present invention in an operating status.

When the jogging platform 2 is lifted upward, as shown in FIG. 4, the linear actuating device 4 will pull the tube 42 reward, which links the wheels 32 of the wheel base 3 to slide along the rails 13 and the wheel base 3 moves upward, subsequently to support the jogging platform 2, and whereas the rollers 26 will roll the jogging platform 2 to assist the upward movement of the jogging platform 2. The upward movement pivots the jogging platform 2 and the ends 241 of the arms 24 with respect to the ends 242 of the arms 24, which assists to lift up the jogging platform 2. Upon the jogging platform 2 has reached to the position, the wheels 32 and the ends 242 of the arms 24 support the front end of the jogging platform 2 while the rollers 26 support the rear end of the jogging platform 2. This design can hold the jogging platform 2 steady and can undertake more weight in a steady manner.

Figure 5:
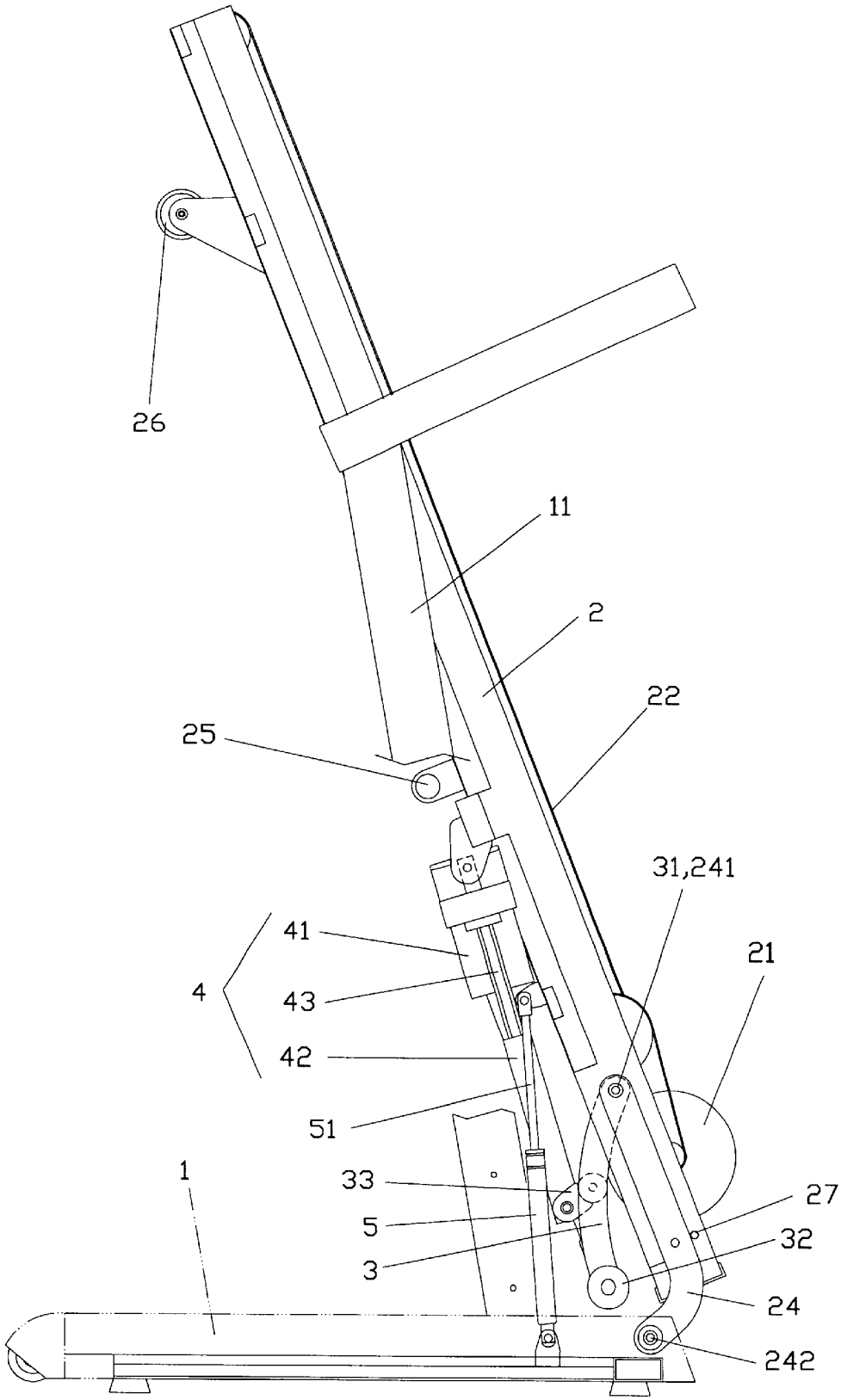
FIG. 5 is a side view of FIG. 1, showing the present invention in a folding status.
Figure 6:
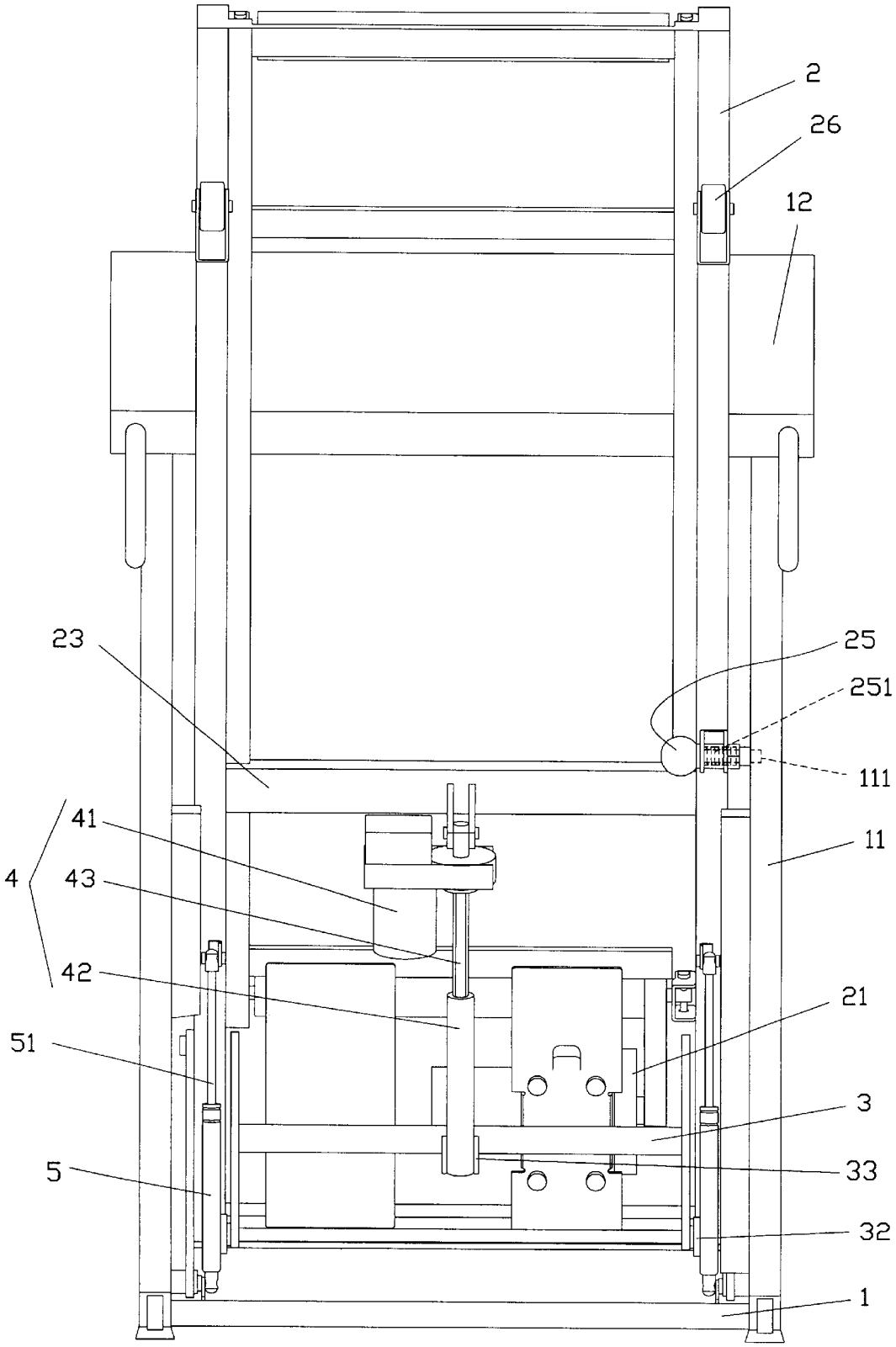
FIG. 6 is a bottom view of the present invention in a folding status.

When the jogging platform 2 is collapsed vertically, as shown in FIGS. 5 and 6, the tube 42 of the linear actuating device 4 will stretch to its maximum length, thus the jogging platform 2 maintains a parallel position with respect to the base 1. The strut 51 of each pump 5 will also stretch to its maximum length, at this moment, wherein the arms 24 also change to an upright position. The stopper 25 of the jogging platform 2 will be urged by the spring 251 to insert into the hole 111 of the base 1, which also keeps the jogging platform 2 in an upright position.

To lay the jogging platform 2 flat, simply pull the stopper 25 to detach from the hole 111, and the jogging platform 2 is free to put down, whereas the strut 51 of the pump 5 buffers the jogging platform 2 to lay in a slow movement.

I claim:

1. A jogging machine having a jogging platform adjustable and foldable structure comprising a base, a jogging platform, a wheel base, a linear actuating device, and two pumps, wherein said base seating flat on the ground with a pair of side supports on respective sides and supporting a panel on a top thereof, said base comprising a pair of rails on respective bottom inner sides thereof, said jogging platform comprising a pair of arms on front respective sides to pivot said jogging platform to said base, each said arm having one end pivoted to said jogging platform and another end pivoted to said base, said wheel base being located underneath said jogging platform, and having one end pivoted to said jogging platform while another end being provided with a pair of wheels, said linear actuating device being secured to the bottom of said jogging platform, and comprising a tube being pivoted to a center rod of said wheel base, so that said tube activating said wheel base to slide along said rails, each of said pumps comprising a strut with one end secured to the bottom of said jogging platform while another end secured to said base, thus said linear actuating device linking said wheel base to slide, and when said jogging platform being moved either upward or downward, said wheels of said wheel base and said arms being supportive devices to collapse said jogging platform, said jogging platform being lifting upwardly with respect to said arms, and said pumps also functioning as supportive devices to said jogging platform in a steady standing position.

2. The jogging machine having a jogging platform adjustable and foldable structure, as recited in claim 1, wherein an elastic stopper is formed on one side of said jogging platform to hold said jogging platform at place when in a folding status.

* * * * *